US012392519B1

(12) United States Patent
Jaber

(10) Patent No.: US 12,392,519 B1
(45) Date of Patent: Aug. 19, 2025

(54) MODEL-BASED AMBIENT TEMPERATURE ESTIMATION FOR CONTROL OF AN HVAC SYSTEM

(71) Applicant: Trane International Inc., Davidson, NC (US)

(72) Inventor: Youssef A Jaber, Tyler, TX (US)

(73) Assignee: Trane International Inc., Davidson, NC (US)

( * ) Notice: Subject to any disclaimer, the term of this patent is extended or adjusted under 35 U.S.C. 154(b) by 566 days.

(21) Appl. No.: 17/024,227

(22) Filed: Sep. 17, 2020

(51) Int. Cl.

| | |
|---|---|
| ***F24F 11/63*** | (2018.01) |
| ***F24F 11/30*** | (2018.01) |
| ***F24F 11/88*** | (2018.01) |
| ***F24F 11/89*** | (2018.01) |
| ***F24F 13/02*** | (2006.01) |
| ***F24F 110/12*** | (2018.01) |
| ***F24F 110/20*** | (2018.01) |

(52) U.S. Cl.
CPC ..... *F24F 11/63* (2018.01); *F24F 11/30* (2018.01); *F24F 11/88* (2018.01); *F24F 11/89* (2018.01); *F24F 13/02* (2013.01); *F24F 2110/12* (2018.01); *F24F 2110/20* (2018.01)

(58) Field of Classification Search
CPC .. F24F 11/63; F24F 11/30; F24F 11/88; F24F 11/89; F24F 13/02; F24F 2110/12; F24F 2110/20
See application file for complete search history.

(56) References Cited

U.S. PATENT DOCUMENTS

| | | | |
|---|---|---|---|
| 7,966,104 | B2 | 6/2011 | Srivastava et al. |
| 8,606,374 | B2 | 12/2013 | Fadell et al. |
| 8,965,587 | B2 | 2/2015 | Modi et al. |
| 9,016,593 | B2 | 4/2015 | Metselaar |
| 9,037,302 | B2 | 5/2015 | O'Neill et al. |
| 9,417,637 | B2 | 8/2016 | Matsuoka et al. |
| 9,664,400 | B2 | 5/2017 | Wroblewski et al. |
| 10,012,407 | B2 | 7/2018 | Modi et al. |
| 10,107,513 | B2 | 10/2018 | Fadell et al. |
| 10,132,517 | B2 | 11/2018 | Modi et al. |
| 10,161,774 | B2 | 12/2018 | Nortman et al. |

(Continued)

*Primary Examiner* — Robert E Fennema
*Assistant Examiner* — Yvonne Trang Follansbee
(74) *Attorney, Agent, or Firm* — Womble Bond Dickinson (US) LLP

(57) ABSTRACT

A method is provided for controlling an HVAC system. The method includes obtaining observations of a measured temperature by at least one temperature sensor, and accessing a lumped-element model of the at least one temperature sensor in which a change in the measured temperature is expressed as a function of one or more independent variables including the measured temperature, and unknown parameter(s) including an ambient temperature of the conditioned space. A regression analysis of the lumped-element model is performed using observations of the one or more independent variables including the observations of the measured temperature, and estimates of the unknown parameter(s), to determine updated estimates of the unknown parameter(s) including an updated estimate of the ambient temperature. A value of the ambient temperature is determined from the updated estimate of the ambient temperature, and HVAC equipment is controlled using the value of the ambient temperature.

20 Claims, 7 Drawing Sheets

(56) References Cited

U.S. PATENT DOCUMENTS

| | | | | |
|---|---|---|---|---|
| 10,317,862 | B2 | 6/2019 | Ajax et al. | |
| 10,443,876 | B2 | 10/2019 | Erickson et al. | |
| 2008/0029611 | A1* | 2/2008 | Schnell | F24F 11/0008 236/44 C |
| 2009/0005912 | A1* | 1/2009 | Srivastava | G05B 13/044 700/276 |
| 2014/0222217 | A1* | 8/2014 | Fadell | G05B 13/048 700/276 |
| 2014/0249876 | A1* | 9/2014 | Wu | G05B 15/02 705/7.12 |
| 2014/0303789 | A1 | 10/2014 | Wroblewski et al. | |
| 2015/0100165 | A1* | 4/2015 | Federspiel | G05B 13/026 700/276 |
| 2015/0178421 | A1 | 6/2015 | Borrelli et al. | |
| 2017/0051933 | A1 | 2/2017 | Verhoeven et al. | |
| 2017/0051934 | A1 | 2/2017 | Verhoeven et al. | |
| 2019/0178521 | A1 | 6/2019 | Zimmerman et al. | |
| 2019/0236446 | A1 | 8/2019 | Qin | |
| 2019/0293494 | A1 | 9/2019 | Mao et al. | |
| 2019/0346170 | A1 | 11/2019 | Benefield | |
| 2020/0348040 | A1* | 11/2020 | Furman | F24F 11/84 |

* cited by examiner

MODEL-BASED AMBIENT TEMPERATURE ESTIMATION FOR CONTROL OF AN HVAC SYSTEM

TECHNOLOGICAL FIELD

The present disclosure relates generally to control of heating, ventilation, and/or air conditioning (HVAC) systems, and in particular, control of HVAC equipment using a model-based ambient temperature estimation.

BACKGROUND

Climate control systems, such as heating, ventilation, and/or air conditioning (HVAC) systems are used in residential and/or commercial areas to heat, cool or otherwise condition interior spaces. The function and control of HVAC equipment is typically adjusted by a thermostat that is configured to measure temperature in a conditioned space. The measured temperature from the thermostat does not always correlate well with the actual ambient temperature of the conditioned space, with the measured temperature often above the ambient temperature. The ambient temperature is the primary feedback signal used for comfort control, so an uncorrelated signal can lead to poor comfort control, and in many cases, it can even induce a sustained controller instability.

A fixed correction can be applied to reduce the difference, but if that difference is dynamic as a function of external conditions, correcting for it becomes significantly harder. To be more specific, in heating, a dynamic offset may reverse the direction of measured temperature at the start of the cycle. That is, instead of measuring an increase in temperature when heating, the measured temperature may actually drop at the start of each cycle as a result of the applied airflow. This may cause the comfort controller to over-deliver on capacity and overshoot its target. In cooling, the drop in temperature may be exaggerated at the start of the cycle, which may cause the controller to under-deliver on capacity and over-cycle the equipment, which may have negative consequences on the reliability of the unit.

Also, because the relative humidity is a function of temperature, any noise source that causes the temperature to fluctuate may reduce the accuracy of the reported relative humidity. This may also lead to poor latent capacity control if the control uses relative humidity for feedback.

BRIEF SUMMARY

Example implementations of the present disclosure provide an HVAC system and method of control that use model-based ambient temperature estimation. The ambient temperature estimation according to example implementations uses a transient model or a combination of transient models with measurements from one or more sensors to get an accurate estimate of the ambient temperature in a conditioned space, and perhaps also its humidity. The one or more sensors may include a conditioned air temperature sensor, a return air temperature sensor, a humidity sensor, HVAC equipment sensors (e.g., airflow, compressor speed, outdoor temperature), or the like. The models may be adaptive and modular. They may learn many of their parameters in real-time (or near real-time) and adjust the source measurements for the estimate to ensure a clean output.

The present disclosure thus includes, without limitation, the following example implementations.

Some example implementations provide a heating, ventilation, and air conditioning (HVAC) system comprising HVAC equipment configured to provide conditioned air to a conditioned space; at least one temperature sensor; and control circuitry operably coupled to the HVAC equipment and the at least one temperature sensor, the control circuitry configured to at least: obtain observations of a measured temperature by the at least one temperature sensor; access a lumped-element model of the at least one temperature sensor in which a change in the measured temperature is expressed as a function of one or more independent variables including the measured temperature, and one or more unknown parameters including an ambient temperature of the conditioned space; perform a regression analysis of the lumped-element model using observations of the one or more independent variables including the observations of the measured temperature, and estimates of the one or more unknown parameters, to determine updated estimates of the one or more unknown parameters including an updated estimate of the ambient temperature; determine a value of the ambient temperature from the updated estimate of the ambient temperature; and control the HVAC equipment using the value of the ambient temperature.

In some example implementations of the HVAC system of any preceding example implementation, or any combination of any preceding example implementations, the control circuitry configured to perform the regression analysis includes the control circuitry configured to at least apply an observation of the measured temperature and the estimates of the one or more unknown parameters to the lumped-element model to determine a predicted change in the measured temperature; determine an observed change in the measured temperature from the observations of the measured temperature; determine an error between the predicted change and the observed change in the measured temperature; and perform the regression analysis to update the estimates of the one or more unknown parameters to the updated estimates of the one or more unknown parameters that cause the predicted change in the measured temperature to be closer to the observed change in the measured temperature, and thereby reduce the error.

In some example implementations of the HVAC system of any preceding example implementation, or any combination of any preceding example implementations, the at least one temperature sensor includes a conditioned air temperature sensor for the conditioned space, the one or more independent variables include the measured temperature from the conditioned air temperature sensor, and the one or more unknown parameters further include at least one thermal parameter of the conditioned air temperature sensor.

In some example implementations of the HVAC system of any preceding example implementation, or any combination of any preceding example implementations, wherein the HVAC equipment is operably coupleable with a return air duct, the at least one temperature sensor includes a return air temperature sensor for return air from the return air duct, the one or more independent variables include the measured temperature from the return air temperature sensor, and the one or more unknown parameters further include a temperature around the return air duct, and at least one thermal parameter of the return air temperature sensor.

In some example implementations of the HVAC system of any preceding example implementation, or any combination of any preceding example implementations, wherein the HVAC equipment is operably coupleable with a return air duct, the at least one temperature sensor includes a conditioned air temperature sensor for the conditioned space, and a return air temperature sensor for return air from the return air duct, wherein the control circuitry configured to access the lumped-element model includes the control circuitry configured to access lumped-element models of the conditioned air temperature sensor and the return air temperature sensor, wherein the control circuitry configured to perform the regression analysis includes the control circuitry configured to perform regression analyses of the lumped-element models to determine respective updated estimates of the ambient temperature, and wherein the control circuitry is configured to determine the value of the ambient temperature from the respective updated estimates of the ambient temperature.

In some example implementations of the HVAC system of any preceding example implementation, or any combination of any preceding example implementations, the control circuitry is further configured to at least obtain observations of the ambient temperature from the lumped-element model of the at least one temperature sensor; access a lumped-element model of the conditioned space in which a change in the ambient temperature is expressed as a function of respective independent variables including the ambient temperature, an outdoor temperature, and an output capacity of the HVAC system, and respective one or more unknown parameters including thermal parameters of the conditioned space; perform a regression analysis of the lumped-element model of the conditioned space using observations of the respective independent variables including the observations of the ambient temperature, and estimates of the respective one or more unknown parameters, to determine updated estimates of the respective one or more unknown parameters; and apply the observations of the respective independent variables and the updated estimates of the respective one or more unknown parameters to the lumped-element model of the conditioned space to determine a second updated estimate of the ambient temperature, and wherein the control circuitry is configured to determine the value of the ambient temperature from the updated estimate of the ambient temperature and the second updated estimate of the ambient temperature.

In some example implementations of the HVAC system of any preceding example implementation, or any combination of any preceding example implementations, the control circuitry configured to perform the regression analysis of the lumped-element model of the conditioned space includes the control circuitry configured to at least apply observations of the respective independent variables and the estimates of the respective one or more unknown parameters to the lumped-element model of the conditioned space to determine a predicted change in the ambient temperature; determine an observed change in the ambient temperature from the observations of the ambient temperature; determine an error between the predicted change and the observed change in the ambient temperature; and perform the regression analysis to update the estimates of the one or more unknown parameters to the updated estimates of the one or more unknown parameters that cause the predicted change in the ambient temperature to be closer to the observed change in the ambient temperature, and thereby reduce the error.

In some example implementations of the HVAC system of any preceding example implementation, or any combination of any preceding example implementations, the HVAC system further comprises a humidity sensor, and the control circuitry is further configured to at least obtain an observation of measured dew point by the humidity sensor and the at least one temperature sensor; access a relative humidity model in which dew point is expressed as function of respective one or more unknown parameters including the ambient temperature and a relative humidity fraction; and perform a regression analysis of the relative humidity model using the observation of the measured dew point, and estimates of the respective one or more unknown parameters, to determine updated estimates of the respective one or more unknown parameters including a second updated estimate of the ambient temperature, and wherein the control circuitry is configured to determine the value of the ambient temperature from the updated estimate of the ambient temperature and the second updated estimate of the ambient temperature.

In some example implementations of the HVAC system of any preceding example implementation, or any combination of any preceding example implementations, the control circuitry configured to perform the regression analysis of the relative humidity model includes the control circuitry configured to at least apply the estimates of the respective one or more unknown parameters to the relative humidity model to determine a predicted dew point; determine an error between the predicted dew point and the observation of the measured dew point; and perform the regression analysis to update the estimates of the respective one or more unknown parameters to the updated estimates of the respective one or more unknown parameters that cause the predicted dew point to be closer to the observation of the measured dew point, and thereby reduce the error.

In some example implementations of the HVAC system of any preceding example implementation, or any combination of any preceding example implementations, the at least one temperature sensor includes a conditioned air temperature sensor for the conditioned space, and a return air temperature sensor for return air from a return air duct, and the HVAC system further comprises a humidity sensor, wherein the control circuitry configured to access the lumped-element model includes the control circuitry configured to access lumped-element models of the conditioned air temperature sensor, the return air temperature sensor and the conditioned space, and further includes the control circuitry configured to access a relative humidity model, wherein the control circuitry configured to perform the regression analysis includes the control circuitry configured to perform regression analyses of the lumped-element models and the relative humidity model using observations of respective independent variables including measured temperature from the conditioned air temperature sensor and the return air temperature sensor, an output capacity of the HVAC system, and measured dew point from the humidity sensor and the conditioned air temperature sensor, the regression analyses performed to determine respective updated estimates of the ambient temperature, and wherein the control circuitry is configured to determine the value of the ambient temperature from the respective updated estimates of the ambient temperature.

Some example implementations provide a method of controlling a heating, ventilation, and air conditioning (HVAC) system that includes HVAC equipment configured to provide conditioned air to a conditioned space, and that includes at least one temperature sensor, the method comprising obtaining observations of a measured temperature by the at least one temperature sensor; accessing a lumped-element model of the at least one temperature sensor in which a change in the measured temperature is expressed as a function of one or more independent variables including the measured temperature, and one or more unknown parameters including an ambient temperature of the conditioned space; performing a regression analysis of the lumped-element model using observations of the one or more independent variables including the observations of the measured temperature, and estimates of the one or more unknown parameters, to determine updated estimates of the one or more unknown parameters including an updated estimate of the ambient temperature; determining a value of the ambient temperature from the updated estimate of the ambient temperature; and controlling the HVAC equipment using the value of the ambient temperature.

In some example implementations of the method of any preceding example implementation, or any combination of any preceding example implementations, performing the regression analysis comprises applying an observation of the measured temperature and the estimates of the one or more unknown parameters to the lumped-element model to determine a predicted change in the measured temperature; determining an observed change in the measured temperature from the observations of the measured temperature; determining an error between the predicted change and the observed change in the measured temperature; and performing the regression analysis to update the estimates of the one or more unknown parameters to the updated estimates of the one or more unknown parameters that cause the predicted change in the measured temperature to be closer to the observed change in the measured temperature, and thereby reduce the error.

In some example implementations of the method of any preceding example implementation, or any combination of any preceding example implementations, the at least one temperature sensor includes a conditioned air temperature sensor for the conditioned space, the one or more independent variables include the measured temperature from the conditioned air temperature sensor, and the one or more unknown parameters further include at least one thermal parameter of the conditioned air temperature sensor.

In some example implementations of the method of any preceding example implementation, or any combination of any preceding example implementations, the HVAC system further includes a return air duct, the at least one temperature sensor includes a return air temperature sensor for return air from the return air duct, the one or more independent variables include the measured temperature from the return air temperature sensor, and the one or more unknown parameters further include a temperature around the return air duct, and at least one thermal parameter of the return air temperature sensor.

In some example implementations of the method of any preceding example implementation, or any combination of any preceding example implementations, the HVAC system further includes a return air duct, and the at least one temperature sensor includes a conditioned air temperature sensor for the conditioned space, and a return air temperature sensor for return air from the return air duct, wherein accessing the lumped-element model includes accessing lumped-element models of the conditioned air temperature sensor and the return air temperature sensor, wherein performing the regression analysis includes performing regression analyses of the lumped-element models to determine respective updated estimates of the ambient temperature, and wherein the value of the ambient temperature is determined from the respective updated estimates of the ambient temperature.

In some example implementations of the method of any preceding example implementation, or any combination of any preceding example implementations, the method further comprises obtaining observations of the ambient temperature from the lumped-element model of the at least one temperature sensor; accessing a lumped-element model of the conditioned space in which a change in the ambient temperature is expressed as a function of respective independent variables including the ambient temperature, an outdoor temperature, and an output capacity of the HVAC system, and respective one or more unknown parameters including thermal parameters of the conditioned space; performing a regression analysis of the lumped-element model of the conditioned space using observations of the respective independent variables including the observations of the ambient temperature, and estimates of the respective one or more unknown parameters, to determine updated estimates of the respective one or more unknown parameters; and applying the observations of the respective independent variables and the updated estimates of the respective one or more unknown parameters to the lumped-element model of the conditioned space to determine a second updated estimate of the ambient temperature, and wherein the value of the ambient temperature is determined from the updated estimate of the ambient temperature and the second updated estimate of the ambient temperature.

In some example implementations of the method of any preceding example implementation, or any combination of any preceding example implementations, performing the regression analysis of the lumped-element model of the conditioned space comprises applying observations of the respective independent variables and the estimates of the respective one or more unknown parameters to the lumped-element model of the conditioned space to determine a predicted change in the ambient temperature; determining an observed change in the ambient temperature from the observations of the ambient temperature; determining an error between the predicted change and the observed change in the ambient temperature; and performing the regression analysis to update the estimates of the one or more unknown parameters to the updated estimates of the one or more unknown parameters that cause the predicted change in the ambient temperature to be closer to the observed change in the ambient temperature, and thereby reduce the error.

In some example implementations of the method of any preceding example implementation, or any combination of any preceding example implementations, the HVAC system further includes a humidity sensor, and the method further comprises obtaining an observation of measured dew point by the humidity sensor and the at least one temperature sensor; accessing a relative humidity model in which dew point is expressed as function of respective one or more unknown parameters including the ambient temperature and a relative humidity fraction; and performing a regression analysis of the relative humidity model using the observation of the measured dew point, and estimates of the respective one or more unknown parameters, to determine updated estimates of the respective one or more unknown parameters including a second updated estimate of the ambient temperature, and wherein the value of the ambient temperature is determined from the updated estimate of the ambient temperature and the second updated estimate of the ambient temperature.

In some example implementations of the method of any preceding example implementation, or any combination of any preceding example implementations, performing the regression analysis of the relative humidity model comprises applying the estimates of the respective one or more unknown parameters to the relative humidity model to determine a predicted dew point; determining an error between the predicted dew point and the observation of the measured dew point; and performing the regression analysis to update the estimates of the respective one or more unknown parameters to the updated estimates of the respective one or more unknown parameters that cause the predicted dew point to be closer to the observation of the measured dew point, and thereby reduce the error.

In some example implementations of the method of any preceding example implementation, or any combination of any preceding example implementations, the at least one temperature sensor includes a conditioned air temperature sensor for the conditioned space, and a return air temperature sensor for return air from a return air duct, and the HVAC system further includes a humidity sensor, wherein accessing the lumped-element model includes accessing lumped-element models of the conditioned air temperature sensor, the return air temperature sensor and the conditioned space, and further includes accessing a relative humidity model, wherein performing the regression analysis includes performing regression analyses of the lumped-element models and the relative humidity model using observations of respective independent variables including measured temperature from the conditioned air temperature sensor and the return air temperature sensor, an output capacity of the HVAC system, and measured dew point from the humidity sensor and the conditioned air temperature sensor, the regression analyses performed to determine respective updated estimates of the ambient temperature, and wherein the value of the ambient temperature is determined from the respective updated estimates of the ambient temperature.

These and other features, aspects, and advantages of the present disclosure will be apparent from a reading of the following detailed description together with the accompanying figures, which are briefly described below. The present disclosure includes any combination of two, three, four or more features or elements set forth in this disclosure, regardless of whether such features or elements are expressly combined or otherwise recited in a specific example implementation described herein. This disclosure is intended to be read holistically such that any separable features or elements of the disclosure, in any of its aspects and example implementations, should be viewed as combinable unless the context of the disclosure clearly dictates otherwise.

It will therefore be appreciated that this Brief Summary is provided merely for purposes of summarizing some example implementations so as to provide a basic understanding of some aspects of the disclosure. Accordingly, it will be appreciated that the above described example implementations are merely examples and should not be construed to narrow the scope or spirit of the disclosure in any way. Other example implementations, aspects and advantages will become apparent from the following detailed description taken in conjunction with the accompanying figures which illustrate, by way of example, the principles of some described example implementations.

BRIEF DESCRIPTION OF THE FIGURE(S)

Having thus described example implementations of the disclosure in general terms, reference will now be made to the accompanying figures, which are not necessarily drawn to scale, and wherein:

DETAILED DESCRIPTION

Figure 1:
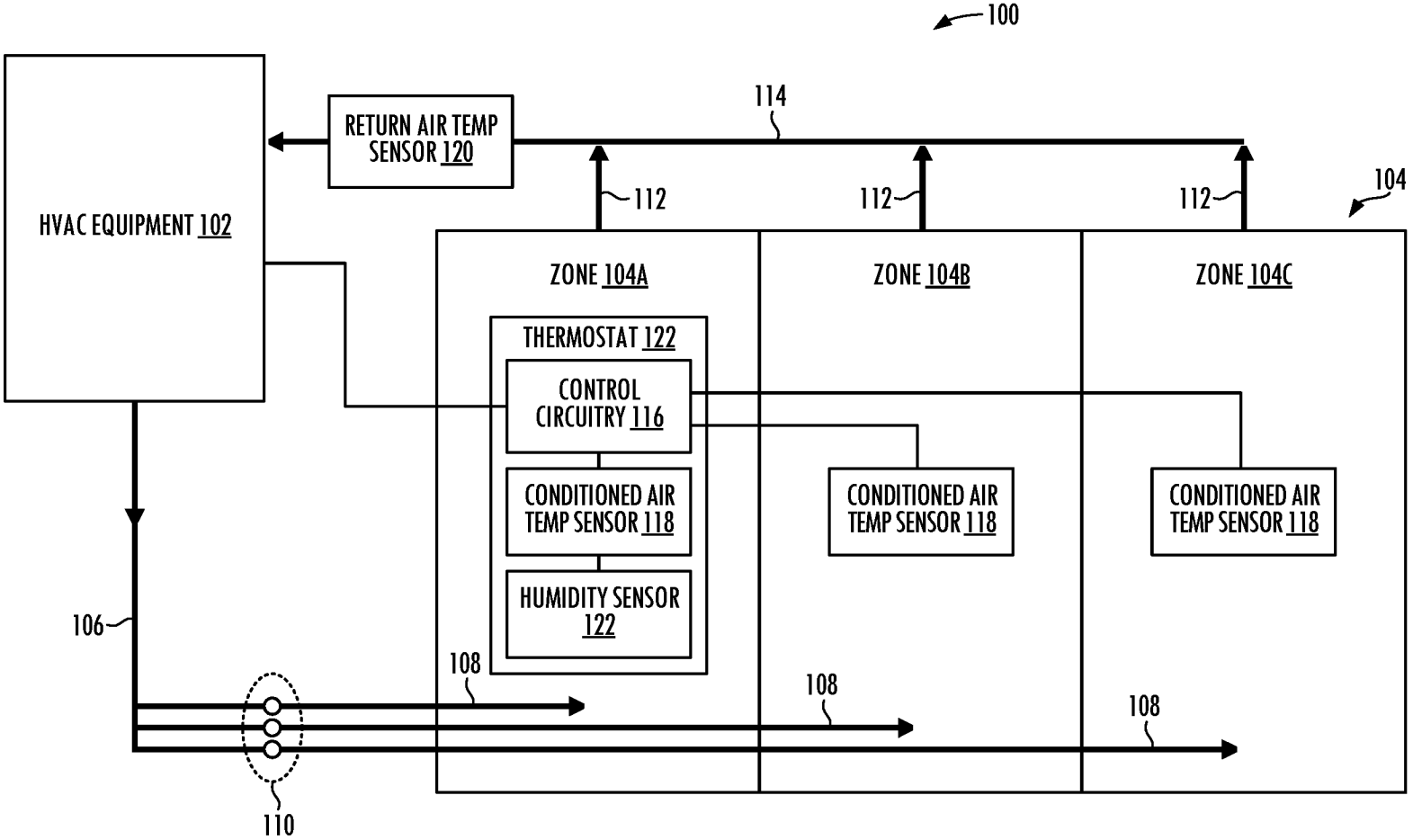
FIG. 1 is a block diagram of a heating, ventilation, and air conditioning (HVAC) system according to some example implementations of the present disclosure.

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

Unless specified otherwise or clear from context, references to first, second or the like should not be construed to imply a particular order. A feature described as being above another feature (unless specified otherwise or clear from context) may instead be below, and vice versa; and similarly, features described as being to the left of another feature else may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Furthermore, it should be understood that unless otherwise specified, the terms "data," "content," "digital content," "information," "observation" and similar terms may be at times used interchangeably.

Example implementations of the present disclosure relate generally to control of heating, ventilation, and/or air conditioning (HVAC) systems, and in particular, control of HVAC equipment using a model-based ambient temperature estimation. The ambient temperature estimation according to example implementations uses a transient model or a combination of transient models with measurements from one or more sensors to get an accurate estimate of the ambient temperature in a conditioned space, and perhaps also its humidity. The one or more sensors may include a conditioned air temperature sensor, a return air temperature sensor, a humidity sensor, HVAC equipment sensors (e.g., airflow, compressor speed, outdoor temperature), or the like. The models may be adaptive and modular. They may learn many of their parameters in real-time (or near real-time) and adjust the source measurements for the estimate to ensure a clean output.

FIG. 1 is a block diagram of an HVAC system 100 according to some example implementations of the present disclosure. The HVAC system generally includes HVAC equipment 102 configured to provide conditioned air to a conditioned space 104, which in some examples may be divided into a plurality of zones 104A, 104B 104C (each of which may itself be a conditioned space). It will be appreciated that while three zones are shown, any number of zones may be present (including a single zone). It will also be appreciated that references to the conditioned zone may be equally applicable to one or more zones of the conditioned space, each of which, again, may itself be a conditioned space.

The HAVAC equipment 102 may include an indoor unit, an outdoor unit, and a refrigerant loop extending between the indoor unit and the outdoor unit. The indoor unit may include a furnace or air handler, an indoor refrigerant heat exchanger or evaporator to condition air (heat or cool), and an indoor fan to circulate or otherwise provide the conditioned air to the conditioned space. The outdoor unit may include an outdoor fan and an outdoor refrigerant heat exchanger or condenser, and the refrigerant loop may extend between the indoor and outdoor refrigerant heat exchangers.

The HVAC system 100 may include an air circulation path with supply air ducts including a main supply air duct 106 and zone supply air ducts 108 through which the conditioned air from the HAVAC equipment 102 is provided to the zones 104A, 104B, 104C of the conditioned space 104; and to control airflow to the zones, the HPVAC equipment may include zone dampers 110. The air circulation path also includes return air ducts including zone return air ducts 112 and a main return air duct 114 operably coupleable with the HVAC equipment, and through which air in the zones of the conditioned space is returned to the HVAC equipment as return air.

The HVAC system 100 includes control circuitry 116 operably coupled with the HVAC equipment 102, and configured to control the HVAC equipment to provide the conditioned air to heat or cool the conditioned space 104, or in some examples, zones 104A, 104B, 104C of the conditioned space. In some examples, the control circuitry is configured to control the HVAC equipment based on environmental feedback from one or more sensors operably coupled to the control circuitry. In this regard, the HVAC system may include at least one temperature sensor.

In particular, for example, the HVAC system 100 may include a conditioned air temperature sensor 118 in the conditioned space 104 configured to measure temperature in the conditioned space. In some examples, as shown, one or more of the zones 104A, 104B, 104C may include a respective conditioned air temperature sensor for the zone and configured to measure temperature in the zone. In some examples, the at least one temperature sensor may include a return air temperature sensor 120 for return air from a return air duct, such as in one or more of the zone return air ducts 112 and/or the main return air duct 114 (shown), In some further examples, the return air temperature sensor may be installed in the HVAC equipment 102 such as in the furnace or the air handler near inlets for return air, or the return air temperature sensor may be installed in the return air duct. And in some examples, the HVAC system 100 also includes a humidity sensor 122 configured to measure relative humidity.

In some examples, the at least one temperature sensor (e.g., conditioned air temperature sensor 118, return air temperature sensor 120) may be co-located with or otherwise includes one or more electronic devices or circuitry that generate heat. In this regard, the control circuitry 116 (or some portion of the control circuitry) and a conditioned air temperature sensor 120 may be co-located in a thermostat 122, which may also include the humidity sensor 122. In other examples, the control circuitry and the conditioned air temperature sensor may be separated and connected by wire or wirelessly; and in some of these examples, the conditioned air temperature sensor may be co-located with other electronic devices or circuitry such as a display device, network adapter, or the like.

According to some example implementations of the present disclosure, the control circuitry 116 is configured to obtain observations of a measured temperature by at least one temperature sensor, such as the conditioned air temperature sensor 118 and/or the return air temperature sensor 120. In some of these examples, the control circuitry is configured to access a lumped-element model of the at least one temperature sensor in which a change in the measured temperature is expressed as a function of one or more independent variables including the measured temperature, and one or more unknown parameters including an ambient temperature of the conditioned space 104. As described herein, the term "parameter" refers to a characteristic used to define or classify a system being modeled, and may be used in the context of statistical analysis of the model. In the context of control engineering, one or more of these parameters may be considered states or state variables of what is modeled.

The control circuitry 116 is configured to perform a regression analysis of the lumped-element model using observations of the one or more independent variables including the observations of the measured temperature, and estimates of the one or more unknown parameters, to determine updated estimates of the one or more unknown parameters including an updated estimate of the ambient temperature. The control circuitry is configured to determine a value of the ambient temperature from the updated estimate of the ambient temperature. And the control circuitry is configured to control the HVAC equipment 102 using the value of the ambient temperature. In this regard, the control circuitry may be configured to control the HVAC equipment to provide conditioned air to heat or cool the conditioned space 104 so that the ambient temperature is maintained at or near a setpoint temperature.

In some examples, the regression analysis includes the control circuitry 116 configured to apply an observation of the measured temperature and the estimates of the one or more unknown parameters to the lumped-element model to determine a predicted change in the measured temperature. In some of these examples, the control circuitry is configured to determine an observed change in the measured temperature from the observations of the measured temperature, and determine an error between the predicted change and the observed change in the measured temperature. The control circuitry, then, is configured to perform the regression analysis to update the estimates of the one or more unknown parameters to the updated estimates of the one or more unknown parameters that cause the predicted change in the measured temperature to be closer to the observed change in the measured temperature, and thereby reduce the error. In some examples, backpropagation may be used to calculate the gradient of a cost function according to which the error is determined, and gradient descent may be used to update the estimates of the one or more unknown parameters. In other examples, backpropagation may be replaced with direct analytical differentiation, or numerical differentiation methods may be employed.

Figure 2:
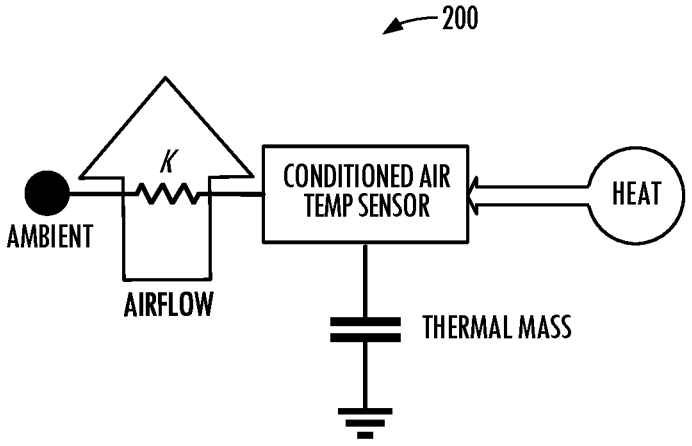
FIGS. 2, 3 and 4 illustrate lumped-element models of respectively a conditioned air temperature sensor, a return air temperature sensor, and a conditioned space, according to some example implementations.

FIG. 2 illustrates a lumped-element model 200 of a conditioned air temperature sensor 118, according to some example implementations. In this model, the change in the measured temperature is expressed as a function of the one or more independent variables includes the measured temperature from the conditioned air temperature sensor, and the unknown parameters include the ambient temperature and at least one thermal parameter of the conditioned air temperature sensor. Examples of suitable thermal parameters include heat generation, thermal resistance to ambient, thermal capacitance and the like. In some examples, one or more of the thermal parameters are impacted by the one or more electronic devices or circuitry co-located or otherwise included with the conditioned air temperature sensor.

More notationally, the lumped-element model 200 of the conditioned air temperature sensor 118 may be expressed as follows:

$$\frac{dT_{Measured}}{dt} = \frac{\dot{Q}_{Sensor}}{C_{Sensor}} + \left(\frac{T_{Ambient} - T_{Measured}}{C_{Sensor}R_{Sensor}}\right) \tag{1}$$

In equation (1), $T_{Measured}$ and $T_{Ambient}$ represent respectively the measured temperature and the ambient temperature. The thermal parameters $\dot{Q}_{sensor}$, $C_{Sensor}$ and $R_{Sensor}$ represent respectively internal heat generated by the conditioned air temperature sensor, thermal capacitance of the conditioned air temperature sensor, and thermal resistance of the conditioned air temperature sensor to ambient.

The thermal resistance of the conditioned air temperature sensor 118 to ambient may change depending on external conditions such as airflow. To account for this, the lumped-element model 200 of the conditioned air temperature sensor may be modified so that the rightmost term increases as a function of airflow:

$$\frac{dT_{Measured}}{dt} = \frac{\dot{Q}_{Sensor}}{C_{Sensor}} + \left(\frac{T_{Ambient} - T_{Measured}}{C_{Sensor}R_{Sensor}}\right)(1 + \text{Airflow} \times K_{Airflow}) \tag{2}$$

In equation (2), Airflow represents airflow generated by the HVAC equipment 102, such as the indoor fan configured to circulate or otherwise provide the conditioned air to the conditioned space 104. Also in equation (2), $K_{Airflow}$ is another thermal parameter that represents sensitivity of the conditioned air temperature sensor to airflow.

An observation of the measured temperature $T_{Measured}$ may be available from the conditioned air temperature sensor 118, and some of the thermal parameters may be characterized or otherwise pre-determined in a controlled test or calibration. The control circuitry 116 may be configured to perform regression analysis to determine a value of the ambient temperature of the conditioned space 104, along with others of the unknown thermal parameters. In particular, for example, assume $\dot{Q}_{sensor}$, $C_{Sensor}$ and $R_{Sensor}$ are pre-determined, the control circuitry 116 may be configured to perform a backpropagation-based regression analysis to determine values of $T_{Ambient}$ and $K_{Airflow}$.

In some examples, an observation of $T_{Measured}$, and estimates of $T_{Ambient}$ and $K_{Airflow}$, may be applied to the lumped-element model expressed as in equation (2) to determine a predicted change in the measured temperature:

$$\left(\frac{dT_{Measured}}{dt}\right)_{Predicted}.$$

The estimates of $T_{Ambient}$ and $K_{Airflow}$ may be obtained in a number of different manners. In some examples, $T_{Ambient}$ may be estimated as equal to $T_{Measured}$ on startup of the HVAC system 100; and following startup, $T_{Ambient}$ may be estimated at steady state by setting $$\frac{dT_{Measured}}{dt}$$

to zero, and solving equation (1) for $T_{Ambient}$. In some examples, $K_{Airflow}$ may be initially estimated to be zero.

In addition to determining the predicted change in the measured temperature, an observed change in the measured temperature may be determined from observations of the measured temperature:

$$\frac{dT_{Measured}}{dt} = \frac{|T_{Measured}|_t - |T_{Measured}|_{t-\Delta t}}{\Delta t} \tag{3}$$

For the regression analysis, a cost function may be used to determine an error between the predicted change and the observed change, such as according to the following:

$$\text{Error} = \frac{1}{2}\left(\left(\frac{dT_{Measured}}{dt}\right)_{Predicted} - \frac{dT_{Measured}}{dt}\right)^2 \tag{4}$$

The partial derivative of the error with respect to the predicted change in the measured temperature is:

$$\frac{dError}{d(dT_{Measured}/dt)_{Predicted}} = \left(\frac{dT_{Measured}}{dt}\right)_{Predicted} - \frac{dT_{Measured}}{dt} \tag{5}$$

To update the estimates of $T_{Ambient}$ and $K_{Airflow}$, gradients of the cost function in equation (4) with respect to the estimates may be found from their partial derivatives with respect to the predicted change in the measured temperature:

$$\frac{d(dT_{Measured}/dt)}{dK_{Airflow}} = \text{Airflow} \times \left(\frac{T_{Ambient} - T_{Measured}}{C_{Sensor}R_{Sensor}}\right) \tag{6}$$

$$\frac{d(dT_{Measured}/dt)}{dT_{Ambient}} = \left(\frac{1 - \text{Airflow} \times K_{Airflow}}{C_{Sensor}R_{Sensor}}\right) \tag{7}$$

The estimates may then be updated from the gradients, such as according to a stochastic gradient descent:

$$K_{Airflow} = K_{Airflow} - \varepsilon_K\left(\frac{d(dT_{Measured}/dt)}{dK_{Airflow}} \times \frac{dError}{d(dT_{Measured}/dt)_{Predicted}}\right) \tag{8}$$

$$T_{Ambient} = T_{Ambient} - \varepsilon_T\left(\frac{d(dT_{Measured}/dt)}{dT_{Ambient}} \times \frac{dError}{d(dT_{Measured}/dt)_{Predicted}}\right) \tag{9}$$

In equations (8) and (9), $\varepsilon_K$ and $\varepsilon_T$ represent learning rates that may be configured in any of a number of different manners. In some examples, the learning rates may be set to fixed values that facilitate convergence and stability. In other examples, either or both the learning rate or the gradient may be adaptive according to a stochastic gradient descent optimizer algorithm, suitable examples of which include gradient descent with momentum, adaptive gradient (AdaGrad), root mean square prop (RMSprop), Adadelta, adaptive momentum estimation (Adam), AdaMax, or the like. The process may be repeated at a fixed interval to maintain the estimated $T_{Ambient}$ close to its actual value. The approach may also be repeated for multiple conditioned air temperature sensors 118 or other sensors to increase accuracy of the value of the ambient temperature.

Figure 3:
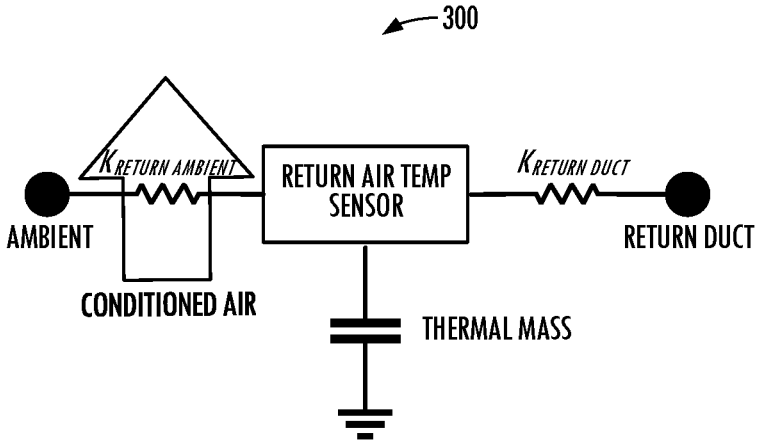

FIG. 3 illustrates a lumped-element model 300 of a return air temperature sensor 120, according to some example implementations. The return air temperature may vary with airflow through the return air duct (zone return air duct 112, main return air duct 114). That is, the return air temperature may generally drift toward the temperature around the return air duct when there is no airflow, and move toward the ambient temperature when exposed to airflow generated by the HVAC equipment 102. In this model, the one or more independent variables include the measured temperature from the return air temperature sensor, and the unknown parameters include the ambient temperature, a temperature around the return air duct, and at least one thermal parameter of the return air temperature sensor.

The lumped-element model of the return air temperature sensor 120 may be expressed as:

$$\frac{dT_{Measured}}{dt} = \frac{T_{Duct} - T_{Measured}}{C_{Sensor}R_{Sensor_Duct}} + \left(\frac{T_{Ambient} - T_{Measured}}{C_{Sensor}R_{Sensor_Ambient}}\right) \times (\text{Airflow} \times K_{Airflow}) \tag{10}$$

Similar to above, $T_{Measured}$ and $T_{Ambient}$ represent respectively the measured temperature from the return air temperature sensor 120 and the ambient temperature of the conditioned space 104, and $T_{Duct}$ represents the temperature around the return air duct. Also, thermal parameters $C_{Sensor}$, $R_{Sensor}$ Duct, $R_{Sensor}$ Ambient and $K_{Airflow}$ represent respectively thermal capacitance of the return air temperature sensor, thermal resistance of the return air temperature sensor to the area around the duct, thermal resistance of the return air temperature sensor to ambient, and sensitivity of the return air temperature sensor to airflow.

In some examples, some of the thermal parameters of the lumped-element model of the return air temperature sensor 120 may be lumped together to simplify the model:

$$\frac{dT_{Measured}}{dt} = (T_{Duct} - T_{Measured}) \times K_{Return\ Duct} + (T_{Ambient} - T_{Measured}) \times \text{Airflow} \times K_{Return\ Ambient} \tag{11}$$

In equation (11), $K_{Return\ Duct}$ and $K_{Return\ Ambient}$ are expressions of the thermal parameters in equation (10) and are themselves unknown thermal parameters:

$$K_{Return\ Duct} = \frac{1}{C_{Sensor}R_{Sensor_Duct}},\ K_{Return\ Ambient} = \frac{K_{R\ Airflow}}{C_{Sensor}R_{Sensor_Ambient}}$$

The control circuitry 116 may be configured to perform a backpropagation-based regression analysis to determine values of the unknown parameters $T_{Ambient}$, $T_{Duct}$, $K_{Return\ Duct}$ and $K_{Return\ Ambient}$.

In some examples, an observation of $T_{Measured}$, and estimates of $T_{Ambient}$, $T_{Duct}$, $K_{Return\ Duct}$ and $K_{Return\ Ambient}$, may be applied to the lumped-element model expressed as in equation (11) to determine a predicted change in the measured temperature:

$$\left(\frac{dT_{Measured}}{dt}\right)_{Predicted}.$$

In some examples, the estimate of $T_{Ambient}$ may be obtained in the same manner as described above for the lumped-element model 200 of the conditioned air temperature sensor 118. In some examples, $T_{Duct}$ may be estimated equal to $T_{Measured}$, and $K_{Return\ Duct}$ and $K_{Return\ Ambient}$ may be initially estimated to be zero.

In addition to determining the predicted change in the measured temperature, an observed change in the measured temperature may be determined from observations of the measured temperature using equation (3), similar to above but with $T_{Measured}$ being the measured temperature from the return air temperature sensor 120. Also similar to above, the error between the predicted change and the observed change in the measured temperature may be determined according to equation (4), and the partial derivative of the error with respect to the predicted change in the measured temperature may be determined according to equation (5).

To update the estimates of $T_{Ambient}$, $T_{Duct}$, $K_{Return\ Duct}$ and $K_{Return\ Ambient}$, gradients of the cost function in equation (4) with respect to the estimates may be found from their partial derivatives with respect to the predicted change in the measured temperature:

$$\frac{d(dT_{Measured}/dt)}{dK_{Return\ Ambient}} = \text{Airflow} \times (T_{Ambient} - T_{Measured}) \tag{12}$$

$$\frac{d(dT_{Measured}/dt)}{dK_{Return\ Duct}} = (T_{Duct} - T_{Measured}) \tag{13}$$

$$\frac{d(dT_{Measured}/dt)}{dT_{Ambient}} = K_{Return\ Ambient} \times \text{Airflow} \times T_{Ambient} \tag{14}$$

$$\frac{d(dT_{Measured}/dt)}{dT_{Duct}} = K_{Return\ Duct} \tag{15}$$

The estimates may then be updated from the gradients, such as according to a stochastic gradient descent:

$$K_{Return\ Ambient} = K_{Return\ Ambient} - \varepsilon_{RA}\left(\frac{d(dT_{Measured}/dt)}{dK_{Return\ Ambient}} \times \frac{dError}{d(dT_{Measured}/dt)_{Predicted}}\right) \tag{16}$$

$$K_{Return\ Duct} = K_{Return\ Duct} - \varepsilon_{RD}\left(\frac{d(dT_{Measured}/dt)}{dK_{Return\ Duct}} \times \frac{dError}{d(dT_{Measured}/dt)_{Predicted}}\right) \tag{17}$$

$$T_{Duct} = T_{Duct} - \varepsilon_{D}\left(\frac{d(dT_{Measured}/dt)}{dT_{Duct}} \times \frac{dError}{d(dT_{Measured}/dt)_{Predicted}}\right) \tag{18}$$

$$T_{Ambient} = T_{Ambient} - \varepsilon_{A}\left(\frac{d(dT_{Measured}/dt)}{dT_{Ambient}} \times \frac{dError}{d(dT_{Measured}/dt)_{Predicted}}\right) \tag{19}$$

In equations (16), (17), (18) and (19), $\varepsilon_{RA}$, $\varepsilon_{RD}$, $\varepsilon_D$ and $\varepsilon_A$ represent learning rates that, again, may be configured in any of a number of different manners. In some examples, the learning rates may be set to fixed values that facilitate convergence and stability. In other examples, either or both the learning rate or the gradient may be adaptive according to a stochastic gradient descent optimizer algorithm, suitable examples of which include gradient descent with momentum, AdaGrad, RMSprop, Adadelta, Adam, AdaMax, or the like. The process may be repeated at a fixed interval to maintain the estimated $T_{Ambient}$ close to its actual value.

Returning to FIG. 1, in some examples, the control circuitry 116 is configured to access a lumped-element model of the conditioned space 104 in which a change in the ambient temperature is expressed as a function of respective independent variables including the ambient temperature, an outdoor temperature, and an output capacity of the HVAC system, and respective one or more unknown parameters including thermal parameters of the conditioned space. In some of these examples, the control circuitry is configured to obtain observations of the ambient temperature from the lumped-element model of the at least one temperature sensor, such as the lumped-element model 200 of the conditioned air temperature sensor 118, or the lumped-element model 300 of the return air temperature sensor 120. The control circuitry is configured to perform a regression analysis of the lumped-element model of the conditioned space using observations of the respective independent variables including the observations of the ambient temperature, and estimates of the respective one or more unknown parameters, to determine updated estimates of the respective one or more unknown parameters.

Also in some of these examples, the control circuitry 116 is configured to apply the observations of the respective independent variables and the updated estimates of the respective one or more unknown parameters to the lumped-element model of the conditioned space 104 to determine an estimate of the ambient temperature. The control circuitry is configured to determine a value of the ambient temperature from the estimate of the ambient temperature, and control the HVAC equipment 102 using the value of the ambient temperature.

In some examples, the regression analysis of the lumped-element model of the conditioned space 104 includes the control circuitry 116 configured to apply observations of the respective independent variables and the estimates of the respective one or more unknown parameters to the lumped-element model of the conditioned space to determine a predicted change in the ambient temperature. In some of these examples, the control circuitry is configured to determine an observed change in the ambient temperature from the observations of the ambient temperature, and determine an error between the predicted change and the observed change in the ambient temperature. The control circuitry, then, is configured to perform the regression analysis to update the estimates of the one or more unknown parameters to the updated estimates of the one or more unknown parameters that cause the predicted change in the ambient temperature to be closer to the observed change in the ambient temperature, and thereby reduce the error.

Figure 4:
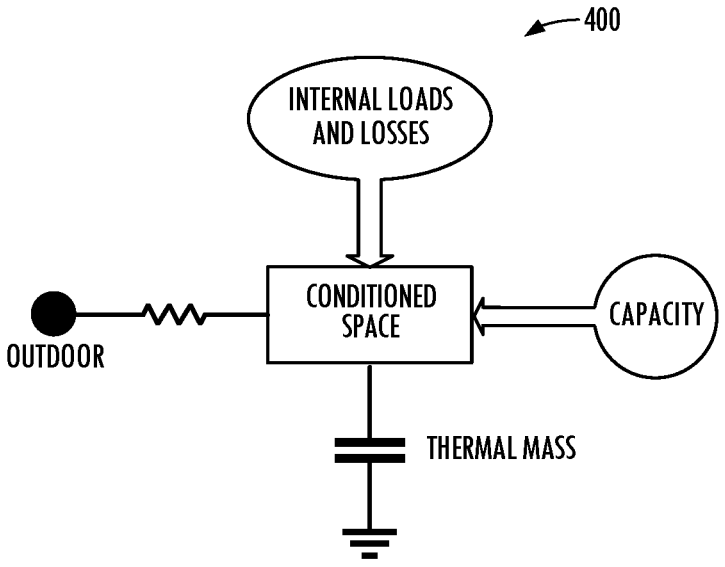

FIG. 4 illustrates a lumped-element model 400 of a conditioned space 104, according to some example implementations. This model may be used to predict the expected behavior of the conditioned space in response to an output capacity of the HVAC system 100, and may be used to determine a value of the ambient temperature of the conditioned space 104, or improve a value of the ambient temperature. In some examples, a one node model may be used and expressed notationally as follows:

$$\frac{dT_{Ambient}}{dt} = \frac{T_{Out} - T_{Ambient}}{C_{Space}R_{Ambient\ Out}} + \frac{\text{Capacity}}{C_{Space}} + \frac{\dot{Q}_{Internal}}{C_{Space}} \tag{20}$$

In the above, $T_{Out}$ represents an outdoor temperature, $C_{Space}$ represents thermal capacitance of the conditioned space, and $R_{Ambient\ Out}$ represents thermal resistance between the conditioned air and outdoor. Also in the above, Capacity represents the output capacity of the HVAC system, and $\dot{Q}_{Internal}$ represents heat generated or lost due to other factors such as internal loads, leakage, metabolic heat and the like.

In some examples, some of the thermal parameters of the lumped-element model of the conditioned space 104 may be lumped together to simplify the model:

$$\frac{dT_{Ambient}}{dt} = (T_{Out} - T_{Ambient}) \times K_{Ambient\ Out} + \text{Capacity} \times K_{Cap} + C_{Internal\ Heat} \tag{21}$$

In equation (21), $K_{Ambient\ Out}$, $K_{Cap}$ and $C_{Internal\ Heat}$ are expressions of the thermal parameters in equation (20) and are themselves unknown thermal parameters:

$$K_{Ambient\ Out} = \frac{1}{C_{Space}R_{Ambient\ Out}},\ K_{Cap} = \frac{1}{C_{Space}},\ C_{Internal\ Heat} = \frac{\dot{Q}_{Internal}}{C_{Space}}$$

Similar to the models described above, the control circuitry 116 may be configured to perform a backpropagation-based regression analysis to determine values of the unknown parameters $K_{Ambient\ Out}$, $K_{Cap}$ and $C_{Internal\ Heat}$.

In the lumped-element model of the conditioned space 104, the independent variables include $T_{Ambient}$, $T_{Out}$ and Capacity. The unknown parameters include the thermal parameters $C_{Space}$, $R_{Ambient\ Out}$ and $Q_{Internal}$; and correspondingly, the lumped expressions $K_{Ambient\ Out}$, $K_{Cap}$ and $C_{Internal\ Heat}$ that are also thermal parameters. The control circuitry 116 may be configured to perform a regression analysis using observations of the independent variables, and estimates of the unknown parameters, to determine updated estimates of the respective unknown parameters, which may then be applied back to the lumped-element model to determine an estimate of the ambient temperature.

More particularly, in some examples, observations of $T_{Ambient}$, $T_{Out}$ and Capacity, and estimates of $K_{Ambient\ Out}$, $K_{Cap}$ and $C_{Internal\ Heat}$, may be applied to the lumped-element model expressed as in equation (21) to determine a predicted change in the ambient temperature:

$$\left(\frac{dT_{Ambient}}{dt}\right)_{Predicted}.$$

In some examples, observations of $T_{Ambient}$ may be obtained from one or more of the other models, such as the lumped-element model 200 of the conditioned air temperature sensor 118, or the lumped-element model 300 of the return air temperature sensor 120. The observation of $T_{Out}$ may be obtained directly or indirectly from a temperature sensor located outside the conditioned space 104, and the observation of Capacity may be known to the control circuitry 116. In some examples, the estimates of $K_{Ambient\ Out}$, $K_{Cap}$ and $C_{Internal\ Heat}$ may be obtained using the observations of $T_{Ambient}$, $T_{Out}$ and Capacity, and solving equation (21).

In addition to determining a predicted change in the ambient temperature, an observed change in the ambient temperature from observations of the ambient temperature:

$$\frac{dT_{Ambient}}{dt} = \frac{|T_{Ambient}|_t - |T_{Ambient}|_{t-\Delta t}}{\Delta t} \tag{22}$$

An error between the predicted change and the observed change in the ambient temperature, and the partial derivative of the error with respect to the predicted change in the measured temperature, may be determined according to equations (23) and (24):

$$\text{Error} = \frac{1}{2}\left(\left(\frac{dT_{Ambient}}{dt}\right)_{Predicted} - \frac{dT_{Ambient}}{dt}\right)^2 \tag{23}$$

$$\frac{dError}{d(dT_{Ambient}/dt)_{Predicted}} = \left(\frac{dT_{Ambient}}{dt}\right)_{Predicted} - \frac{dT_{Ambient}}{dt} \tag{24}$$

To update the estimates of $K_{Ambient\ Out}$, $K_{Cap}$ and $C_{Internal\ Heat}$, gradients of the cost function in equation (23) with respect to the estimates may be found from their partial derivatives with respect to the predicted change in the ambient temperature:

$$\frac{d(dT_{Ambient}/dt)}{dK_{Ambient\ Out}} = (T_{Out} - T_{Ambient}) \tag{25}$$

$$\frac{d(dT_{Ambient}/dt)}{dK_{Cap}} = \text{Capacity} \tag{26}$$

$$\frac{d(dT_{Ambient}/dt)}{dC_{Internal\ Heat}} = 1 \tag{27}$$

The estimates may then be updated from the gradients, such as according to a stochastic gradient descent:

$$K_{Ambient\ Out} = K_{Ambient\ Out} - \varepsilon_{AO}\left(\frac{d(dT_{Ambient}/dt)}{dK_{Ambient\ Out}} \times \frac{dError}{d(dT_{Ambient}/dt)_{Predicted}}\right) \tag{28}$$

$$K_{Cap} = K_{Cap} - \varepsilon_{Cap}\left(\frac{d(dT_{Ambient}/dt)}{dK_{Cap}} \times \frac{dError}{d(dT_{Ambient}/dt)_{Predicted}}\right) \tag{29}$$

$$C_{Internal\ Heat} = C_{Internal\ Heat} - \varepsilon_{IH}\left(\frac{d(dT_{Ambient}/dt)}{dC_{Internal\ Heat}} \times \frac{dError}{d(dT_{Ambient}/dt)_{Predicted}}\right) \tag{30}$$

In equations (28), (29) and (30), $\varepsilon_{AO}$, $\varepsilon_{Cap}$ and $\varepsilon_{IH}$ represent learning rates that, again, may be configured in any of a number of different manners. Similar to above, the learning rates may be set to fixed values, or either or both the learning rate or the gradient may be adaptive according to a stochastic gradient descent optimizer algorithm (e.g., gradient descent with momentum, AdaGrad, RMSprop, Adadelta, Adam, AdaMax).

To determine an estimate of the ambient temperature of the conditioned space 104, the observations of $T_{Ambient}$, $T_{Out}$ and Capacity, and the updated estimates of $K_{Ambient\ Out}$, $K_{Cap}$ and $C_{Internal\ Heat}$, may be applied to the lumped-element model:

$$T_{Ambient} = T_{Ambient} + dt \times [(T_{Out} - T_{Ambient}) \times K_{Ambient\ Out} + \text{Capacity} \times K_{cap} + C_{Internal\ Heat}] \tag{31}$$

Again, the process may be repeated at a fixed interval to maintain the estimated $T_{Ambient}$ close to its actual value.

Again returning to FIG. 1, because the heating effect inside and around the thermostat 122 is local, any transient effects that change the dry bulb temperature measurement of the conditioned air temperature sensor 118 locally at the thermostat may not appreciably affect the absolute humidity. The transient dry bulb effects may be much faster than the change of absolute humidity in the ambient air; and accordingly, a relative humidity model may also be defined and used with regression analysis to estimate the ambient temperature.

In some examples in which the HVAC system 100 includes the humidity sensor 122, then, the control circuitry 116 is configured to obtain an observation of measured dew point by the humidity sensor and the conditioned air temperature sensor 118. In this regard, the observation of measured dew point may be determined from the measured temperature from the conditioned air temperature sensor, and measured relative humidity fraction (i.e., relative humidity (RH) expressed as a fraction) from the humidity sensor. The relative humidity (and thereby the relative humidity fraction) is the relative humidity of the conditioned space 104. Notably, the observation of the measured dew point may be considered accurate even if both the measured temperature and the measured relative humidity fraction are inaccurate due to a thermal bias.

Also in some these examples, the control circuitry 116 is configured to access a relative humidity model in which dew point is expressed as function of respective one or more unknown parameters including the ambient temperature and the relative humidity fraction of the conditioned space 104. The control circuitry is configured to perform a regression analysis of the relative humidity model using the observation of the measured dew point, and estimates of the respective one or more unknown parameters, to determine updated estimates of the respective one or more unknown parameters including an updated estimate of the ambient temperature. The control circuitry is configured to determine a value of the ambient temperature from the estimate of the ambient temperature, and control the HVAC equipment 102 using the value of the ambient temperature.

In some examples, the regression analysis of the relative humidity model includes the control circuitry 116 configured to apply the estimates of the respective one or more unknown parameters to the relative humidity model to determine a predicted dew point. The control circuitry is configured to determine an error between the predicted dew point and the observation of the measured dew point. Then the control circuitry is configured to perform the regression analysis to update the estimates of the respective one or more unknown parameters to the updated estimates of the respective one or more unknown parameters that cause the predicted dew point to be closer to the observation of the measured dew point, and thereby reduce the error.

The measured dew point may be obtained in a number of different manners, such as from the Magnus approximation of dew point as a function of the measured temperature from the conditioned air temperature sensor 118 of the thermostat 122, and measured relative humidity fraction from the humidity sensor 122 of the thermostat:

$$T_{DP\ Therm} = 243.04 \times \frac{\ln(PHI_{Measured}) + \frac{(17.625 \times T_{Measured})}{(243.04 \times T_{Measured})}}{17.625 - \ln(PHI_{Measured}) - \frac{(17.625 \times T_{Measured})}{(243.04 + T_{Measured})}} \quad (32)$$

In equation (32), $T_{DP\ Therm}$ represents measured dew point (in degrees Celsius), $T_{Measured}$ represents the measured temperature (dry bulb temperature in degrees Celsius), and $PHI_{Measured}$ represents the measured relative humidity fraction (RH/100).

Although the relative humidity may be different depending on where it is measured (inside versus outside the thermostat 122), the measured dew point may be similar. In some examples, then, the relative humidity model may be defined based on the above Magnus approximation; and in the relative humidity model, dew point may be expressed as function of respective unknown parameters including the ambient temperature $T_{Ambient}$ (in degrees Celsius) and relative humidity fraction PHI:

$$T_{DP\ Therm} = 243.04 \times \frac{\ln(PHI) + \frac{(17.625 \times T_{Ambient})}{(243.04 \times T_{Ambient})}}{17.625 - \ln(PHI)\frac{(17.625 \times T_{Ambient})}{(243.04 + T_{Ambient})}} \quad (33)$$

In some examples, then, the control circuitry 116 may be configured to obtain an observation of $T_{DP\ Therm}$, such as according to equation (32). The control circuitry may be configured to access the relative humidity model as expressed in equation (33), and perform a regression analysis using $T_{DP\ Therm}$ and estimates of $T_{Ambient}$ and PHI to determine updated estimates of the respective unknown parameters including an updated estimate of $T_{Ambient}$. In some examples, $T_{Ambient}$ and PHI may be estimated equal to respectively $T_{Measured}$ and $PHI_{Measured}$ (in degrees Celsius). In some examples, the estimate of $T_{Ambient}$ may be obtained using one or more of the other models, such as the lumped-element model 200 of the conditioned air temperature sensor 118.

The regression analysis may include the control circuitry 116 configured to apply the estimates of $T_{Ambient}$ and PHI to the relative humidity model as expressed in equation (33) to determine a predicted dew point: $(T_{DP\ Therm})_{Predicted}$. An error between the predicted drew point and the observation of the measured dew point, and the partial derivative of the error with respect to the predicted dew point, may be determined according to equations (34) and (35):

$$\text{Error} = \frac{1}{2}((T_{DP\ Therm})_{Predicted} - T_{DP\ Therm})^2 \quad (34)$$

$$\frac{dError}{d(T_{DP\ Therm})_{Predicted}} = (T_{DP\ Therm})_{Predicted} - T_{DP\ Therm} \quad (35)$$

To update the estimates of $T_{Ambient}$ and PHI, gradients of the cost function in equation (34) with respect to the estimates may be found from their partial derivatives with respect to the predicted dew point:

$$\frac{d(T_{DP\ Therm})}{dT_{Ambient}} = \frac{(243.04 \times 17.625)}{PHI \times \left(\ln(PHI) + \frac{17.625 \times T_{Ambient}}{243.04 + T_{Ambient}} - 17.625\right)^2} \quad (36)$$

$$\frac{d(T_{DP\ Therm})}{dPHI} = \frac{(243.04 \times 17.625)^2}{(T_{Ambient} + 243.04)^2 \times \left(17.625 - \ln(PHI) + \frac{17.625 \times T_{Ambient}}{243.04 + T_{Ambient}}\right)^2} \quad (37)$$

The estimates may then be updated from the gradients, such as according to a stochastic gradient descent:

$$T_{Ambient} = T_{Ambient} - \varepsilon_{Amb}\left(\frac{d(T_{DP\ Therm})}{dT_{Ambient}} \times \frac{dError}{dT_{DP\ Therm}}\right) \quad (38)$$

$$PHI = PHI - \varepsilon_{PHI}\left(\frac{d(T_{DP\ Therm})}{dPHI} \times \frac{dError}{dT_{DP\ Therm}}\right) \quad (39)$$

In equations (38) and (39), $\varepsilon_{Amb}$ and $\varepsilon_{PHI}$ represent learning rates that, again, may be configured in any of a number of different manners. Similar to above, the learning rates may be set to fixed values, or either or both the learning rate or the gradient may be adaptive according to a stochastic gradient descent optimizer algorithm (e.g., gradient descent with momentum, AdaGrad, RMSprop, Adadelta, Adam, AdaMax).

Notably, the estimate of PHI may drive accuracy of $T_{Ambient}$. In this regard, if the speed at which the regression changes PHI is adjusted, the relative humidity model may instead be forced to adjust $T_{Ambient}$ since it is the only other unknown parameter that can reduce the error. The hyperparameters of the regression analysis such as $\varepsilon_{Amb}$ and $\varepsilon_{PHI}$, then, may be tuned so that PHI and $T_{Ambient}$ have different rates of change. For example, it may be expected that the outdoor temperature does not change very quickly relative to $T_{Ambient}$, so $\varepsilon_{Amb}$ and $\varepsilon_{PHI}$ may be tuned to converge faster on $T_{Ambient}$, which may increase accuracy of the relative humidity model.

The control circuitry 116 may in various examples use multiple ones of the models to determine the value of the ambient temperature. In some examples, the control circuitry 116 is configured to access lumped-element models of the conditioned air temperature sensor 118 and the return air temperature sensor 120. In some of these examples, the control circuitry is configured to perform regression analyses of the lumped-element models to determine respective updated estimates of the ambient temperature, and determine the value of the ambient temperature from the respective updated estimates of the ambient temperature.

In some examples including lumped-element model(s) of the at least one temperature sensor (e.g., conditioned air temperature sensor 118 and/or the return air temperature sensor 120) and the lumped-element model of the conditioned space 104, the estimate from the lumped-element model of the conditioned space may be a second updated estimate of the ambient temperature. Similarly, in some examples including lumped-element model(s) of the at least one temperature sensor and the relative humidity model, the estimate from the relative humidity model may be a second updated estimate of the ambient temperature. The control circuitry 116, then, may be configured to determine the value of the ambient temperature from the updated estimate of the ambient temperature and the second updated estimate of the ambient temperature.

In some examples, the control circuitry 116 is configured to access lumped-element models of the conditioned air temperature sensor, the return air temperature sensor and the conditioned space, and access a relative humidity model. In some of these examples, the control circuitry is configured to perform regression analyses of the lumped-element models and the relative humidity model using observations of respective independent variables including measured temperature from the conditioned air temperature sensor and the return air temperature sensor, an output capacity of the HVAC system, and measured dew point from the humidity sensor and the conditioned air temperature sensor. The regression analyses are performed to determine respective updated estimates of the ambient temperature, and the control circuitry is configured to determine the value of the ambient temperature from the respective updated estimates of the ambient temperature.

The value of the ambient temperature may be determined from multiple updated estimates of the ambient temperature in a number of different manners. In some examples, the models according to which the estimates are determined may be fused together such as by weighing their derivatives or by using a Kalman filter with a diagonal covariance matrix. In examples including a Kalman filter, diagonal elements for the Kalman filter covariance may be initialized to initially trust one of the models (e.g., lumped-element model of the conditioned air temperature sensor 118) more than the other models, and move its trust to the other models over time. The covariance matrix diagonal terms may also be updated in real-time or near real-time by taking a decaying average of the expected variance of each of their measurements as a function of the variance of their evolving unknown parameters.

To further illustrate the above, estimates of the unknown parameters of the models may initially change quickly during regression, but may update more slowly as they converge. The models may be trusted more as their unknown parameters converge, which may be determined based on the rate of change of their estimates. Convergence of the different models may be compared based on how the estimated ambient temperature changes with changes in others of the unknown parameters. One may also check how the unknown parameters are moving over time. A variation metric on the estimate of ambient temperature from each model may be determined, and the models may be compared to determine relative trust in the models. In this regard, more trusted models may be those that have a lower expected variation on ambient temperature as a result of variations in the model's other unknown parameters. In real-time (or near real-time), the variation may quickly change, which may make the estimate noisy; so to slow down the change, a decaying average of the expected variation may be taken and used to update the Kalman filter gain.

Assume two of the models as an example, each having two unknown parameters that evolve over time during the regression analysis:

$$T_{Ambient_1}=\text{Model}_1(X_1,Y_1)$$

$$T_{Ambient_2}=\text{Model}_2(X_2,Y_2)$$

Now assume that the rate at which those parameters change is given as follows:

$$\frac{dX_1}{dt}=1$$
$$\frac{dY_1}{dt}=3$$
$$\frac{dX_2}{dt}=5$$
$$\frac{dY_2}{dt}=8$$

Also assume that from the model, the effect of those parameters on the estimate of $T_{Ambient}$ around a given point:

$$\frac{dT_{Ambient_1}}{dX_1}=0.01$$
$$\frac{dT_{Ambient_1}}{dY_1}=0.5$$
$$\frac{dT_{Ambient_2}}{dX_2}=0.02$$
$$\frac{dT_{Ambient_2}}{dY_2}=0.1$$

From the above, a variation metric that indicates how $T_{Ambient}$ varies over time as the unknown parameters of each model move may be determined:

$$\text{Variation}(T_{Ambient_1})=\left(\frac{dX_1}{dt}\times\frac{dT_{Ambient_1}}{dX_1}\right)+\left(\frac{dY_1}{dt}\times\frac{dT_{Ambient_1}}{dY_1}\right)=1.51$$
$$\text{Variation}(T_{Ambient_2})=\left(\frac{dX_2}{dt}\times\frac{dT_{Ambient_2}}{dX_2}\right)+\left(\frac{dY_2}{dt}\times\frac{dT_{Ambient_2}}{dY_2}\right)=0.90$$

The second model has a lower expected variation and may therefore be trusted more than the first model. This may be formed into an estimate of the noise covariance matrix (R), which may be used to determine the Kalman filter gain. In some example implementations, then, converge metrics may be used to update which sources of data may be trusted more than others in real-time (or near real-time), which may improve the estimate of $T_{Ambient}$.

Figure 5A:
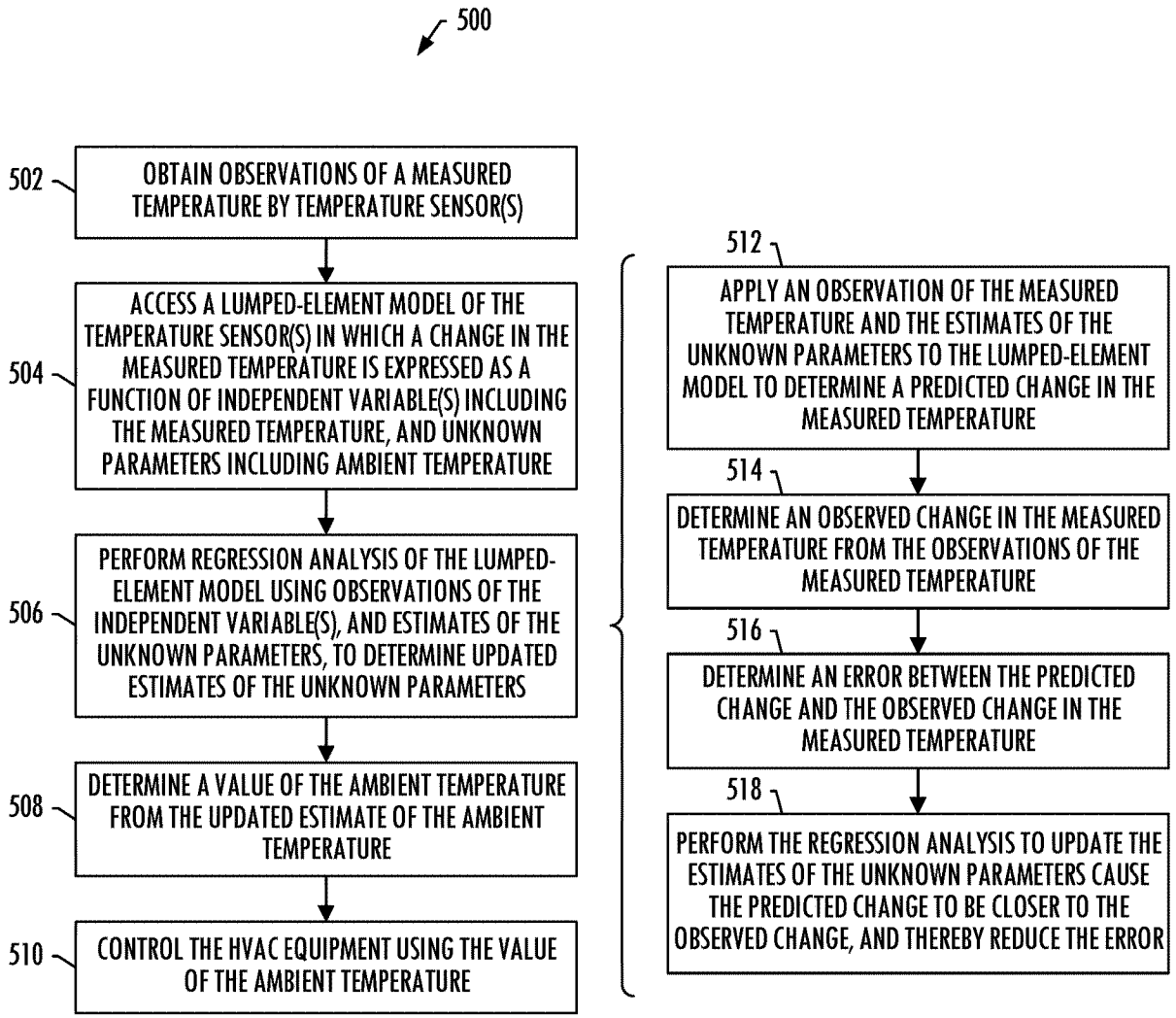
FIGS. 5A, 5B and 5C are flowcharts illustrating various operations in a method of controlling an HVAC system, according to some example implementations.
Figure 5B:
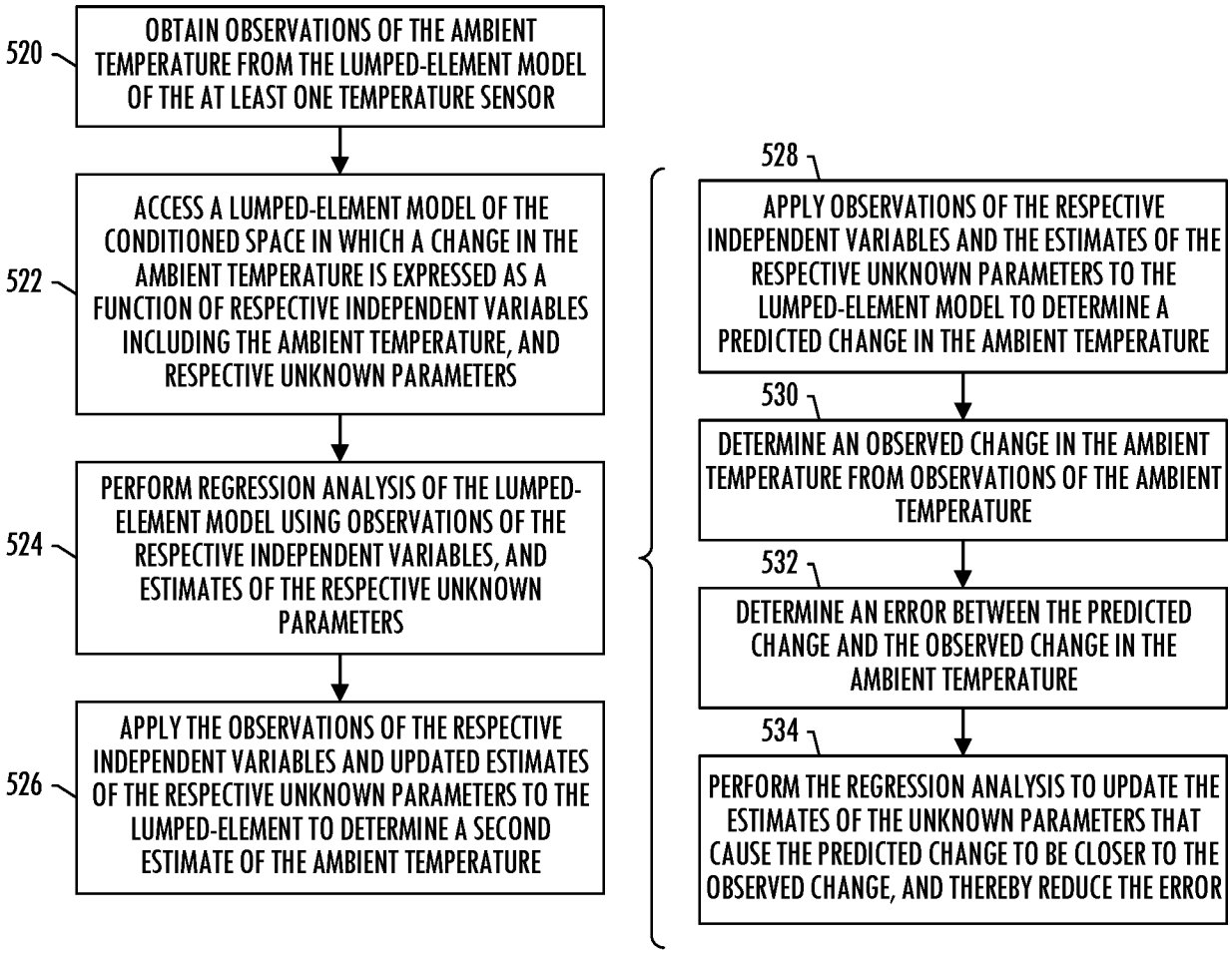
Figure 5C:
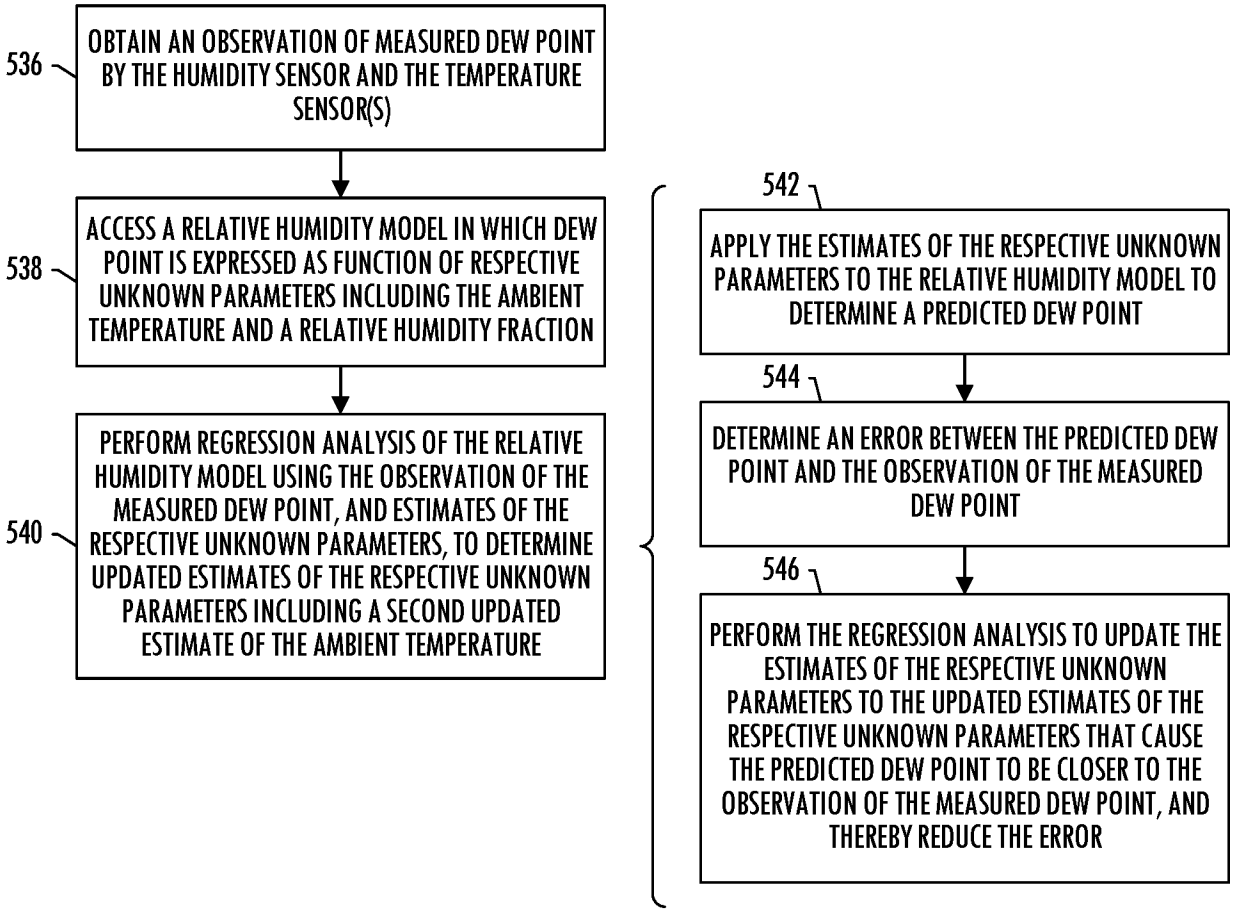

FIGS. 5A, 5B and 5C are flowcharts illustrating various operations in a method 500 of controlling an HVAC system 100, according to some example implementations. Again, the HVAC system includes HVAC equipment 102 configured to provide conditioned air to a conditioned space 104, and that includes at least one temperature sensor (e.g., conditioned air temperature sensor 118, return air temperature sensor 120). As shown at block 502 of FIG. 5A, the method includes obtaining observations of a measured temperature by the at least one temperature sensor. The method includes accessing a lumped-element model of the at least one temperature sensor in which a change in the measured temperature is expressed as a function of one or more independent variables including the measured temperature, and unknown parameters including an ambient temperature of the conditioned space, as shown at block 504.

The method 500 includes performing a regression analysis of the lumped-element model using observations of the one or more independent variables including the observations of the measured temperature, and estimates of the unknown parameters, to determine updated estimates of the unknown parameters including an updated estimate of the ambient temperature, as shown at block 506. And the method includes determining a value of the ambient temperature from the updated estimate of the ambient temperature, and controlling the HVAC equipment using the value of the ambient temperature, as shown at blocks 508 and 510.

In some examples, performing the regression analysis at block 506 includes applying an observation of the measured temperature and the estimates of the unknown parameters to the lumped-element model to determine a predicted change in the measured temperature, as shown at block 512. An observed change in the measured temperature is determined from the observations of the measured temperature, and an error between the predicted change and the observed change in the measured temperature is determined, as shown at blocks 514 and 516. The regression analysis, then, is performed to update the estimates of the unknown parameters to the updated estimates of the unknown parameters that cause the predicted change in the measured temperature to be closer to the observed change in the measured temperature, and thereby reduce the error, as shown at block 518.

In some examples, the at least one temperature sensor includes a conditioned air temperature sensor for the conditioned space. In some of these examples, the one or more independent variables include the measured temperature from the conditioned air temperature sensor, and the unknown parameters further include at least one thermal parameter of the conditioned air temperature sensor.

In some examples, the HVAC equipment is operably coupleable with a return air duct, and the at least one temperature sensor includes a return air temperature sensor for return air from the return air duct. In some of these examples, the one or more independent variables include the measured temperature from the return air temperature sensor, and the unknown parameters further include a temperature around the return air duct, and at least one thermal parameter of the return air temperature sensor.

In some examples, the HVAC equipment is operably coupleable with a return air duct, and the at least one temperature sensor includes a conditioned air temperature sensor for the conditioned space, and a return air temperature sensor for return air from the return air duct. In some of these examples, accessing the lumped-element model at block 504 includes accessing lumped-element models of the conditioned air temperature sensor and the return air temperature sensor. Also in some of these examples, performing the regression analysis at block 506 includes performing regression analyses of the lumped-element models to determine respective updated estimates of the ambient temperature, and the value of the ambient temperature is determined at block 508 from the respective updated estimates of the ambient temperature.

Turning to FIG. 5B, in some examples, the method 500 further includes obtain observations of the ambient temperature from the lumped-element model of the at least one temperature sensor, and accessing a lumped-element model of the conditioned space, as shown at blocks 520 and 522. In the lumped-element model of the conditioned space, a change in the ambient temperature is expressed as a function of respective independent variables including the ambient temperature, an outdoor temperature, and an output capacity of the HVAC system, and respective unknown parameters including thermal parameters of the conditioned space. A regression analysis of the lumped-element model of the conditioned space is performed using observations of the respective independent variables including the observations of the ambient temperature, and estimates of the respective unknown parameters, to determine updated estimates of the respective unknown parameters, as shown at block 524. The observations of the respective independent variables and the updated estimates of the respective unknown parameters are applied to the lumped-element model of the conditioned space to determine a second updated estimate of the ambient temperature, as shown at block 526. The value of the ambient temperature, then, is determined at block 508 from the updated estimate of the ambient temperature and the second updated estimate of the ambient temperature.

In some further examples, performing the regression analysis of the lumped-element model of the conditioned space at block 524 includes applying observations of the respective independent variables and the estimates of the respective unknown parameters to the lumped-element model of the conditioned space to determine a predicted change in the ambient temperature, as shown at block 528. An observed change in the ambient temperature is determined from the observations of the ambient temperature, and an error between the predicted change and the observed change in the ambient temperature is determined, as shown at blocks 530 and 532. The regression analysis is then performed to update the estimates of the unknown parameters to the updated estimates of the unknown parameters that cause the predicted change in the ambient temperature to be closer to the observed change in the ambient temperature, and thereby reduce the error, as shown at block 534.

In some examples, the HVAC system further includes a humidity sensor, and the method 500 further includes obtaining an observation of measured dew point by the humidity sensor and the at least one temperature sensor, as shown at block 536 of FIG. 5C. In some of these examples, the method includes accessing a relative humidity model in which dew point is expressed as a function of respective unknown parameters including the ambient temperature and a relative humidity fraction, as shown at block 538. Also in some of these examples, the method includes performing a regression analysis of the relative humidity model using the observation of the measured dew point, and estimates of the respective unknown parameters, to determine updated estimates of the respective unknown parameters including a second updated estimate of the ambient temperature, as shown at block 540. Similar to before, the value of the ambient temperature is determined at block 508 from the updated estimate of the ambient temperature and the second updated estimate of the ambient temperature.

In some further examples, performing the regression analysis of the relative humidity model at block 540 includes applying the estimates of the respective unknown parameters to the relative humidity model to determine a predicted dew point, as shown at block 542. An error between the predicted dew point and the observation of the measured dew point is determined, as shown at block 544. And the regression analysis is performed to update the estimates of the respective unknown parameters to the updated estimates of the respective unknown parameters that cause the predicted dew point to be closer to the observation of the measured dew point, and thereby reduce the error, as shown at block 546.

Returning to FIG. 5A, in some examples, the at least one temperature sensor includes a conditioned air temperature sensor for the conditioned space, and a return air temperature sensor for return air from a return air duct, and the HVAC system further includes a humidity sensor. In some of these examples, accessing the lumped-element model at block 504 includes accessing lumped-element models of the conditioned air temperature sensor, the return air temperature sensor and the conditioned space, and further includes accessing a relative humidity model. Also in some of these examples, performing the regression analysis at block 506 includes performing regression analyses of the lumped-element models and the relative humidity model using observations of respective independent variables including measured temperature from the conditioned air temperature sensor and the return air temperature sensor, an output capacity of the HVAC system, and measured dew point from the humidity sensor and the conditioned air temperature sensor. The regression analyses are here performed to determine respective updated estimates of the ambient temperature, and the value of the ambient temperature is determined at block 508 from the respective updated estimates of the ambient temperature.

According to example implementations of the present disclosure, the control circuitry 116 may be implemented by various means. Means for implementing the control circuitry may include hardware, alone or under direction of one or more computer programs from a computer-readable storage medium. In some examples, the control circuitry is formed of one or more circuit boards. The control circuitry may be centrally located or distributed throughout the HVAC system 100. For example, the control circuitry may be formed of distinct circuit boards including a circuit board positioned in the thermostat 122, and one or more circuit boards positioned at or within the HVAC equipment 102 (e.g., at the indoor fan configured to circulate or otherwise provide the conditioned air to the conditioned space 104).

Figure 6:
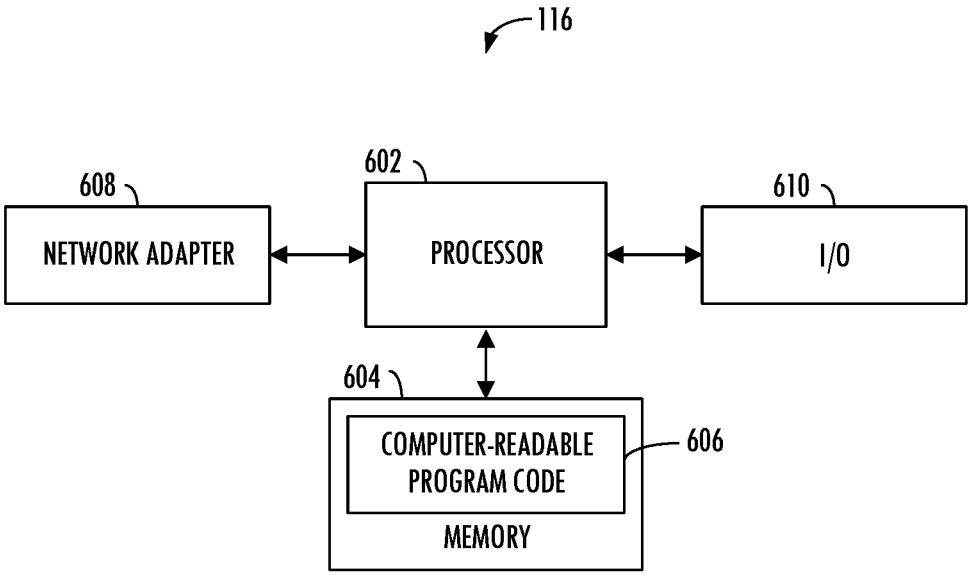
FIG. 6 illustrates control circuitry according to some example implementations.

FIG. 6 illustrates the control circuitry 116 according to some example implementations of the present disclosure. The control circuitry may include one or more of each of a number of components such as, for example, a processor 602 connected to a memory 604. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor 602 may be a number of processors, a multi-core processor or some other type of processor, depending on the particular implementation.

The processor 602 may be configured to execute computer programs such as computer-readable program code 606, which may be stored onboard the processor or otherwise stored in the memory 604. In some examples, the processor may be embodied as or otherwise include one or more ASICs, FPGAs or the like. Thus, although the processor may be capable of executing a computer program to perform one or more functions, the processor of various examples may be capable of performing one or more functions without the aid of a computer program.

The memory 604 is generally any piece of computer hardware capable of storing information such as, for example, data, computer-readable program code 606 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 602, causes the control circuitry 116 to perform various operations as described herein, some of which may in turn cause the HVAC system 100 to perform various operations.

In addition to the memory 604, the processor 602 may also be connected to one or more peripherals such as a network adapter 608, one or more input/output (I/O) devices 610 or the like. The network adapter is a hardware component configured to connect the control circuitry 116 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

Many modifications and other implementations of the disclosure set forth herein will come to mind to one skilled in the art to which the disclosure pertains having the benefit of the teachings presented in the foregoing description and the associated figures. Therefore, it is to be understood that the disclosure is not to be limited to the specific implementations disclosed and that modifications and other implementations are intended to be included within the scope of the appended claims. Moreover, although the foregoing description and the associated figures describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A heating, ventilation, and air conditioning (HVAC) system comprising:

HVAC equipment configured to provide conditioned air to a conditioned space;

a humidity sensor;

at least one temperature sensor, which includes a conditioned air temperature sensor for the conditioned space; and control circuitry operably coupled to the HVAC equipment, the at least one temperature sensor, and the humidity sensor, wherein the humidity sensor, and the conditioned air temperature sensor are co-located in a thermostat, the control circuitry is configured to at least:

obtain observations of a measured temperature by the at least one temperature sensor, wherein the observations comprise an observation of a temperature from at least the conditioned air temperature sensor, and the temperature is affected by the conditioned air temperature sensor being located in the thermostat, obtain an observation of a measured dew point by the humidity sensor, access a lumped-element model of the at least one temperature sensor in which a change in the measured temperature is expressed as a function of one or more independent variables including the measured temperature, and one or more unknown parameters including an ambient temperature of the conditioned space, determine updated estimates of the one or more unknown parameters by performing a regression analysis of the lumped-element model, wherein the regression analysis uses observations of the one or more independent variables that include the observations of the measured temperature and estimates of the one or more unknown parameters, the one or more unknown parameters include an updated estimate of the ambient temperature, the updated estimates of the one or more unknown parameters are determined, at least in part, by accessing a relative humidity model, determining a predicted dew point by applying the estimates of the one or more unknown parameters to the relative humidity model, wherein the regression analysis includes a regression analysis of the relative humidity model, which is based, at least in part, on an observation of the measured dew point and the estimates of the one or more unknown parameters, and determining an updated predicted dew point based, at least in part, on an error between the predicted dew point and the observation of the measured dew point, update the one or more unknown parameters of the lumped-element model to the updated estimates of the one or more unknown parameters, determine the updated estimate of the ambient temperature using the updated lumped-element model of the conditioned air temperature sensor, determine a value of the ambient temperature from the updated estimate of the ambient temperature and the updated predicted dew point, and control the HVAC equipment based, at least in part, on the value of the ambient temperature.

2. The HVAC system of claim 1, wherein the control circuitry configured to perform the regression analysis includes control circuitry configured to at least:

apply an observation of the measured temperature and the estimates of the one or more unknown parameters to the lumped-element model to determine a predicted change in the measured temperature;

determine an observed change in the measured temperature from the observations of the measured temperature;

determine an error between the predicted change and the observed change in the measured temperature; and perform the regression analysis to update the estimates of the one or more unknown parameters to the updated estimates of the one or more unknown parameters that cause the predicted change in the measured temperature to be closer to the observed change in the measured temperature, and thereby reduce the error.

3. The HVAC system of claim 1, wherein the one or more independent variables include the measured temperature from the conditioned air temperature sensor, and the one or more unknown parameters further include at least one thermal parameter of the conditioned air temperature sensor.

4. The HVAC system of claim 1, wherein the HVAC equipment is operably coupleable with a return air duct, the at least one temperature sensor includes a return air temperature sensor for return air from the return air duct, the one or more independent variables include the measured temperature from the return air temperature sensor, and the one or more unknown parameters further include a temperature around the return air duct, and at least one thermal parameter of the return air temperature sensor.

5. The HVAC system of claim 1, wherein the HVAC equipment is operably coupleable with a return air duct, the at least one temperature sensor further includes a return air temperature sensor for return air from the return air duct, wherein the control circuitry configured to access the lumped-element model includes control circuitry configured to access the lumped-element models of the conditioned air temperature sensor and the return air temperature sensor, wherein the control circuitry configured to perform the regression analysis includes control circuitry configured to perform regression analyses of the lumped-element models to determine respective updated estimates of the ambient temperature, and wherein the control circuitry is further configured to determine the value of the ambient temperature from the respective updated estimates of the ambient temperature.

6. The HVAC system of claim 1, wherein the control circuitry is further configured to at least:

obtain observations of the ambient temperature from the lumped-element model of the at least one temperature sensor;

access a lumped-element model of the conditioned space in which a change in the ambient temperature is expressed as a function of respective independent variables including the ambient temperature, an outdoor temperature, and an output capacity of the HVAC system, and respective one or more unknown parameters including thermal parameters of the conditioned space;

perform a regression analysis of the lumped-element model of the conditioned space using observations of the respective independent variables including the observations of the ambient temperature and estimates of the respective one or more unknown parameters, to determine updated estimates of the respective one or more unknown parameters; and apply the observations of the respective independent variables and the updated estimates of the respective one or more unknown parameters to the lumped-element model of the conditioned space to determine a second updated estimate of the ambient temperature, wherein the control circuitry is configured to determine the value of the ambient temperature from the updated estimate of the ambient temperature and the second updated estimate of the ambient temperature.

7. The HVAC system of claim 6, wherein the control circuitry configured to perform the regression analysis of the lumped-element model of the conditioned space includes control circuitry configured to at least:

apply observations of the respective independent variables and the estimates of the respective one or more unknown parameters to the lumped-element model of the conditioned space to determine a predicted change in the ambient temperature;

determine an observed change in the ambient temperature from the observations of the ambient temperature;

determine an error between the predicted change and the observed change in the ambient temperature; and perform the regression analysis to update the estimates of the one or more unknown parameters to the updated estimates of the one or more unknown parameters that cause the predicted change in the ambient temperature to be closer to the observed change in the ambient temperature, and thereby reduce the error.

8. The HVAC system of claim 1, wherein dew point is expressed in the relative humidity model as function of respective one or more unknown parameters including the ambient temperature and a relative humidity fraction and the control circuitry is further configured to at least perform the regression analysis of the relative humidity model to determine updated estimates of the respective one or more unknown parameters including a second updated estimate of the ambient temperature and the updated predicted dew point, wherein the control circuitry is further configured to determine the value of the ambient temperature from the updated estimate of the ambient temperature and the second updated estimate of the ambient temperature.

9. The HVAC system of claim 8, wherein the regression analysis updates the estimates of the respective one or more unknown parameters to the updated estimates of the respective one or more unknown parameters that cause the predicted dew point to be closer to the observation of the measured dew point, and thereby reduce the error.

10. The HVAC system of claim 1, wherein the at least one temperature sensor includes a return air temperature sensor for return air from a return air duct, and wherein the control circuitry configured to access the lumped-element model includes control circuitry configured to access lumped-element models of the conditioned air temperature sensor, the return air temperature sensor and the conditioned space, wherein the control circuitry configured to perform the regression analysis includes control circuitry configured to perform regression analyses of the lumped-element models and the relative humidity model using observations of respective independent variables including measured temperature from the conditioned air temperature sensor and the return air temperature sensor, an output capacity of the HVAC system, and measured dew point from the humidity sensor and the conditioned air temperature sensor, the regression analyses are performed to determine respective updated estimates of the ambient temperature, and the control circuitry is further configured to determine the value of the ambient temperature from the respective updated estimates of the ambient temperature.

11. A method of controlling a heating, ventilation, and air conditioning (HVAC) system that includes HVAC equipment configured to provide conditioned air to a conditioned space, and that includes at least one temperature sensor, which includes a conditioned air temperature sensor for the conditioned space, and a humidity sensor, wherein the conditioned air temperature sensor is located in a thermostat and the humidity sensor is located in the thermostat, the method comprising:

obtaining observations of a measured temperature by the at least one temperature sensor, wherein the observations comprise an observation of a temperature from at least the conditioned air temperature sensor, and the temperature is affected by the conditioned air temperature sensor being located in the thermostat;

obtain an observation of a measured dew point by the humidity sensor;

accessing a lumped-element model of the at least one temperature sensor in which a change in the measured temperature is expressed as a function of one or more independent variables including the measured temperature, and one or more unknown parameters including an ambient temperature of the conditioned space;

determining updated estimates of the one or more unknown parameters by performing a regression analysis of the lumped-element model, wherein the regression analysis uses observations of the one or more independent variables that include the observations of the measured temperature and estimates of the one or more unknown parameters, the one or more unknown parameters include an updated estimate of the ambient temperature, the updated estimates of the one or more unknown parameters are determined, at least in part, by accessing a relative humidity model, determining a predicted dew point by applying the estimates of the one or more unknown parameters to the relative humidity model, wherein the regression analysis includes a regression analysis of the relative humidity model, which is based, at least in part, on an observation of the measured dew point and the estimates of the one or more unknown parameters, and determining an updated predicted dew point at least in part, on an error between the predicted dew point and the observation of the measured dew point, update the one or more unknown parameters of the lumped-element model to the updated estimates of the one or more unknown parameters, determine the updated estimate of the ambient temperature using the updated lumped-element model of the conditioned air temperature sensor;

determine a value of the ambient temperature from the updated estimate of the ambient temperature and the updated predicted dew point; and controlling the HVAC equipment based, at least in part, on the value of the ambient temperature.

12. The method of claim 11, wherein performing the regression analysis comprises:

applying an observation of the measured temperature and the estimates of the one or more unknown parameters to the lumped-element model to determine a predicted change in the measured temperature;

determining an observed change in the measured temperature from the observations of the measured temperature;

determining an error between the predicted change and the observed change in the measured temperature; and performing the regression analysis to update the estimates of the one or more unknown parameters to the updated estimates of the one or more unknown parameters that cause the predicted change in the measured temperature to be closer to the observed change in the measured temperature, and thereby reduce the error.

13. The method of claim 11, wherein the one or more independent variables include the measured temperature from the conditioned air temperature sensor, and the one or more unknown parameters further include at least one thermal parameter of the conditioned air temperature sensor.

14. The method of claim 11, wherein the HVAC system further includes a return air duct, the at least one temperature sensor includes a return air temperature sensor for return air from the return air duct, the one or more independent variables include the measured temperature from the return air temperature sensor, and the one or more unknown parameters further include a temperature around the return air duct, and at least one thermal parameter of the return air temperature sensor.

15. The method of claim 11, wherein the HVAC system further includes a return air duct, and the at least one temperature sensor further includes a return air temperature sensor for return air from the return air duct, the accessing the lumped-element model includes accessing the lumped-element models of the conditioned air temperature sensor and the return air temperature sensor, the performing the regression analysis includes performing regression analyses of the lumped-element models to determine respective updated estimates of the ambient temperature, and the value of the ambient temperature is determined from the respective updated estimates of the ambient temperature.

16. The method of claim 11, further comprising:

obtaining observations of the ambient temperature from the lumped-element model of the at least one temperature sensor;

accessing a lumped-element model of the conditioned space in which a change in the ambient temperature is expressed as a function of respective independent variables including the ambient temperature, an outdoor temperature, and an output capacity of the HVAC system, and respective one or more unknown parameters including thermal parameters of the conditioned space;

performing a regression analysis of the lumped-element model of the conditioned space using observations of the respective independent variables including the observations of the ambient temperature and estimates of the respective one or more unknown parameters, to determine updated estimates of the respective one or more unknown parameters; and applying the observations of the respective independent variables and the updated estimates of the respective one or more unknown parameters to the lumped-element model of the conditioned space to determine a second updated estimate of the ambient temperature, wherein the value of the ambient temperature is determined from the updated estimate of the ambient temperature and the second updated estimate of the ambient temperature.

17. The method of claim 16, wherein performing the regression analysis of the lumped-element model of the conditioned space comprises:

applying observations of the respective independent variables and the estimates of the respective one or more unknown parameters to the lumped-element model of the conditioned space to determine a predicted change in the ambient temperature;

determining an observed change in the ambient temperature from the observations of the ambient temperature;

determining an error between the predicted change and the observed change in the ambient temperature; and performing the regression analysis to update the estimates of the one or more unknown parameters to the updated estimates of the one or more unknown parameters that cause the predicted change in the ambient temperature to be closer to the observed change in the ambient temperature, and thereby reduce the error.

18. The method of claim 11, wherein dew point is expressed in the relative humidity model as function of respective one or more unknown parameters including the ambient temperature and a relative humidity fraction and the method further comprises performing the regression analysis of the relative humidity model, to determine updated estimates of the respective one or more unknown parameters including a second updated estimate of the ambient temperature and the updated predicted dew point, wherein the value of the ambient temperature is determined from the updated estimate of the ambient temperature and the second updated estimate of the ambient temperature.

19. The method of claim 18, wherein the regression analysis updates the estimates of the respective one or more unknown parameters to the updated estimates of the respective one or more unknown parameters that cause the predicted dew point to be closer to the observation of the measured dew point, and thereby reduce the error.

20. The method of claim 11, wherein the at least one temperature sensor includes a return air temperature sensor for return air from a return air duct, and the accessing the lumped-element model includes accessing lumped-element models of the conditioned air temperature sensor, the return air temperature sensor and the conditioned space, and further includes accessing a relative humidity model, the performing the regression analysis includes performing regression analyses of the lumped-element models and the relative humidity model using observations of respective independent variables including measured temperature from the conditioned air temperature sensor and the return air temperature sensor, an output capacity of the HVAC system, and measured dew point from the humidity sensor and the conditioned air temperature sensor, the regression analyses are performed to determine respective updated estimates of the ambient temperature, and the value of the ambient temperature is determined from the respective updated estimates of the ambient temperature.

* * * * *